US006915728B2

(12) United States Patent
Renwick et al.

(10) Patent No.: US 6,915,728 B2
(45) Date of Patent: Jul. 12, 2005

(54) MINE DETONATING APPARATUS AND VEHICLE INCLUDING SUCH APPARATUS

(75) Inventors: Peter John Renwick, Hexham (GB); Graham Emmerson, Chester Le Street (GB)

(73) Assignee: Pearson Engineering Limited, Newcastle Upon Tyne (GB)

( * ) Notice: Subject to any disclaimer, the term of this patent is extended or adjusted under 35 U.S.C. 154(b) by 0 days.

(21) Appl. No.: 10/312,945

(22) PCT Filed: Jun. 19, 2001

(86) PCT No.: PCT/GB01/02662

§ 371 (c)(1),
(2), (4) Date: Sep. 12, 2003

(87) PCT Pub. No.: WO02/03007

PCT Pub. Date: Jan. 10, 2002

(65) Prior Publication Data

US 2004/0035285 A1 Feb. 26, 2004

(51) Int. Cl.[7] ..... F41H 11/16
(52) U.S. Cl. ..... 89/1.13; 102/402
(58) Field of Search ..... 89/1.13; 102/402, 102/403; 172/237, 551

(56) References Cited

U.S. PATENT DOCUMENTS 2,489,349 A * 11/1949 White ..... 89/1.13
4,418,761 A * 12/1983 Dietrich et al. ..... 172/271
4,765,221 A * 8/1988 Sombrowski ..... 89/1.13
4,776,404 A * 10/1988 Rogers et al. ..... 172/21
5,786,542 A * 7/1998 Petrovich et al. ..... 89/1.13

FOREIGN PATENT DOCUMENTS

GB 2 106 045 A * 4/1983

* cited by examiner

*Primary Examiner*—Stephen M. Johnson
(74) *Attorney, Agent, or Firm*—Zilka-Kotab, PC

(57) ABSTRACT

A mine detonating apparatus to be mounted to an armoured personnel carrier (1) is disclosed. A front roller assembly (4) is mounted at the front of a vehicle body (2) of the armoured personnel carrier (1) to apply pressure to the ground forwardly of each track (3) of the armoured personnel carrier (1). A rear roller assembly (10) is mounted rearwardly of the vehicle body (3) to apply pressure to the ground behind the vehicle, the front and rear rollers (4, 10) being pre-loaded. The rear roller assembly (10) is connected to the vehicle body by means of hydraulic cylinders (15, 16) and a support frame (8) supporting the front roller assemblies (4) is connected to the vehicle body (2) by of a pair of hydraulic cylinders (17, 18). The hydraulic cylinders (15, 16, 17, 18) are arranged to maintain the position of the front roller assemblies forwardly of the respective tracks (3).

18 Claims, 3 Drawing Sheets

MINE DETONATING APPARATUS AND VEHICLE INCLUDING SUCH APPARATUS

BACKGROUND AND FIELD OF THE INVENTION

The present application claims the priority of a United Kingdom patent filed Jul. 3, 2000 under application No. 0016402.0.

The present invention relates to mine detonating apparatus and vehicles including such apparatus. The invention relates particularly, but not exclusively, to mine detonating apparatus for use with armoured personnel carriers.

In many situations, such as peacekeeping operations and low intensity conflicts, there is a:requirement for military or peacekeeping personnel to be able to travel along roads which may be mined.

A mine detonating apparatus for use with battle tanks is known. The apparatus includes a pair of heavy rollers known as mine rollers), each of which is located in front of a track of the tank. As the tracks of the tank approach a mine, the weight of the rollers detonates the mine. These rollers are made of steel and are sufficiently strong that they are able to withstand the blast.

Mine detonating apparatus of this type suffers from the drawback that while the heavy sacrificial mine rollers can readily be fitted to battle tanks (weighing approximately 40 to 60 tonne), they are too heavy to be carried on armoured personnel carriers, which generally weigh only approximately 10 to 20 tonne.

A known mine detonating apparatus for use on armoured personnel carriers which seeks to overcome this drawback uses hydraulic force to exert a force of about 2 tonnes on the rollers (which, together with the one tonne weight of the roller applies a force of 3 tonne on the ground) to compensate for the smaller weight of the rollers compared with the rollers used with tanks. However, this arrangement suffers from the drawback that they are only effective when the vehicle is travelling in a relatively straight line, and only operate across the width of the track or wheel of the vehicle and not the region between the tracks or wheels. It is not feasible to modify the prior art rollers to operate across the entire width of the front of the vehicle, since it would not be possible to make front rollers of such width castor, thus significantly impairing the mobility of the vehicle, and the vehicle would have to apply a downward force of about 3.5 tonne to the forward roller assembly to enable the roller assembly to apply the necessary force of about 5 tonne to the ground. This would cause undesirable upward movement of the front of the vehicle.

Preferred embodiments of the present invention seek to overcome the above disadvantages of the prior art.

SUMMARY

According to an aspect of the present invention, there is provided a mine detonating apparatus comprising:

at least one first roller assembly adapted to be mounted at the front of a body of a vehicle and to apply pressure to the ground forwardly of a respective wheel and/or track of the vehicle;

at least one second roller assembly adapted to be mounted behind the vehicle and to apply pressure to the ground behind the vehicle;

force applying means for causing the or each said roller assembly to apply force to the ground; and guide means for maintaining the position of the or each said first roller assembly forwardly of the respective wheel and/or track of the vehicle.

By providing at least one second roller assembly adapted to be mounted behind the vehicle to apply pressure to the ground behind the vehicle, this provides the advantage that mines between the wheels or tracks of the vehicle can be detonated, and the downward force applied to the or each second roller assembly can counteract the downward force applied to the or each first roller assembly, thus minimising tilting of the vehicle. Furthermore, by providing guide means for maintaining the position of the or each said first roller assembly forwardly of the respective wheel or track of the vehicle, this provides the advantage that the apparatus is also effective when the vehicle is travelling around a curved path.

The guide means preferably comprises interconnection means connected in use between said first and second roller assemblies such that pivoting of the body of said vehicle about a respective substantially vertical axis relative to the or each said second roller assembly causes pivoting of the or each said first roller assembly relative to the body of the vehicle.

This provides the advantage that the guide means can be constructed in a relatively simple manner such that the position of the or each first roller assembly relative to the body of the vehicle is automatically controlled by the position of the body of the vehicle relative to the or each second roller assembly.

Said interconnection means may comprise a mechanical linkage.

In a preferred embodiment, said interconnection means comprises at least one first pair of hydraulic cylinders arranged in use between the body of the vehicle and the or each said first roller assembly and at least one second pair of hydraulic cylinders arranged in use between the body of the vehicle and the or each said second roller assembly.

The guide means may comprise position sensor means for determining the position of the or each said first roller assembly relative to the corresponding track and/or wheel of the vehicle, and motor means for controlling the position of the or each said first roller assembly in response to said position sensor means.

Said motor means in use may determine a respective turning circle of the or each said first roller assembly by comparing the speed of wheels and/or tracks, on opposite sides of the vehicle.

In a preferred embodiment, the or each said first and/or second roller assembly is mounted to a frame and is adapted to be released from the body of the vehicle in use by remote control means.

This provides the advantage that if a roller assembly should become damaged because of detonating a mine, the roller assembly can be jettisoned from within the vehicle with the minimum amount of danger to personnel.

The or each said first roller assembly is preferably mounted to a frame in use and is adapted to be released from the frame by said remote control means.

The or each said second roller assembly is preferably mounted to at least one frame in use, and the or each said frame is adapted to be released from the body of the vehicle by said remote control means.

Said remote control means may comprise at least one retractable pin.

In a preferred embodiment, the or each said first and/or said second roller assembly is adapted to pivot about a respective substantially horizontal axis substantially parallel to the direction of travel of the vehicle in use and/or about a substantially vertical axis.

This provides the advantage that the or each roller assembly can castor and/or take account of variations in the height of the ground.

The or each said roller assembly may comprise a plurality of wheels.

The wheels of the or each said roller assembly are preferably suspended independently of each other.

This provides the advantage of enabling the roller to accommodate variations in the height of the ground.

In a preferred embodiment, the apparatus comprises two said first roller assemblies and a said second roller assembly, wherein said second roller assembly in use is adapted to engage the entire width of ground between the ground engaged by said first roller assemblies.

Said force applying means may comprise at least one hydraulic cylinder.

According to another aspect of the present invention, there is provided a vehicle comprising a mine detonating apparatus as defined above.

The vehicle is preferably an armoured personnel carrier.

DESCRIPTION OF THE DRAWINGS

A preferred embodiment of the invention will now be described, by way of example only and not in any limitative sense, with reference to the accompanying drawings, in which.

DETAILED DESCRIPTION

Figure 1:
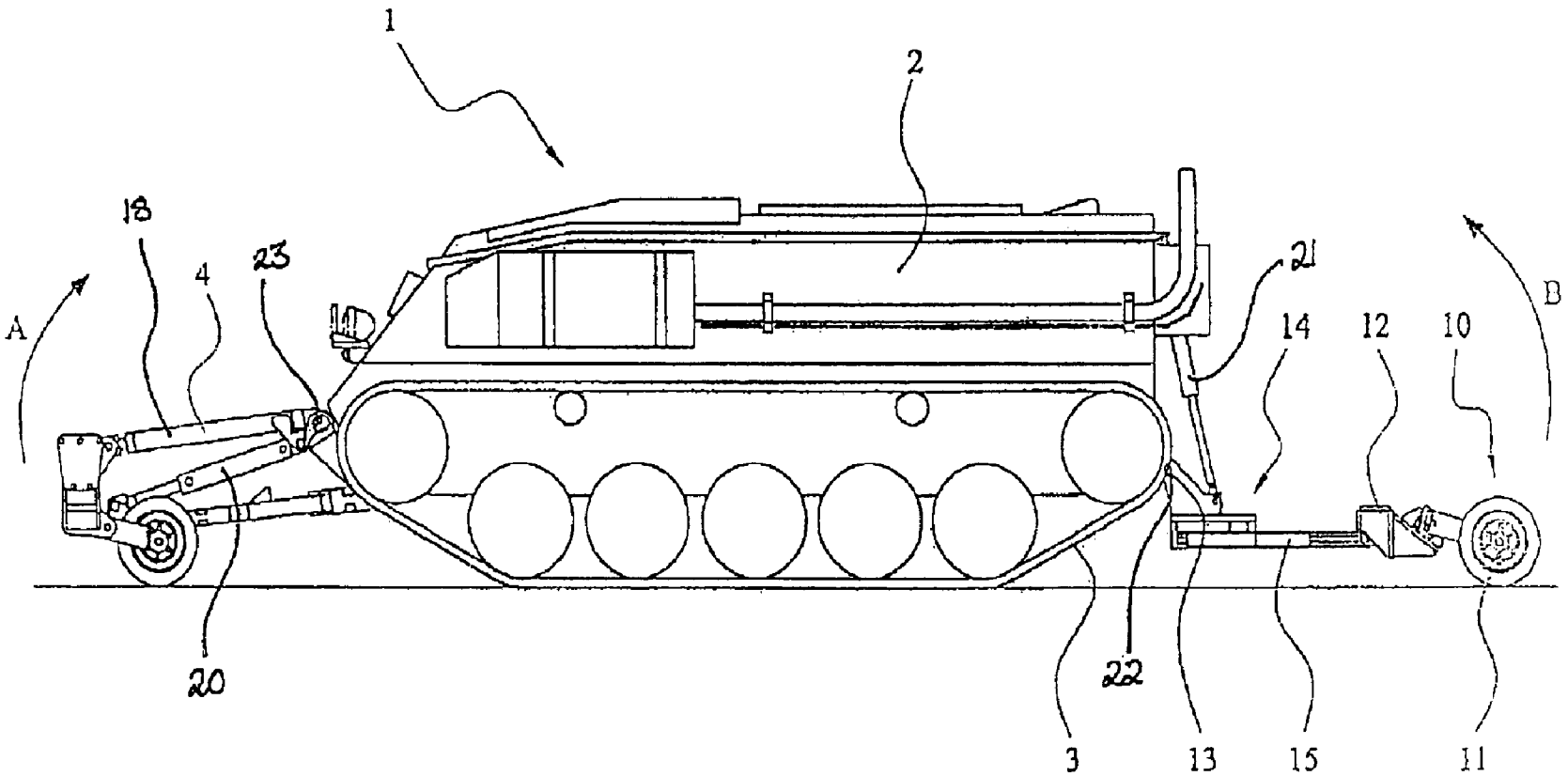
FIG. 1 is a side elevation view of an armoured personnel carrier including a mine detonating apparatus embodying the present invention.
Figure 2:
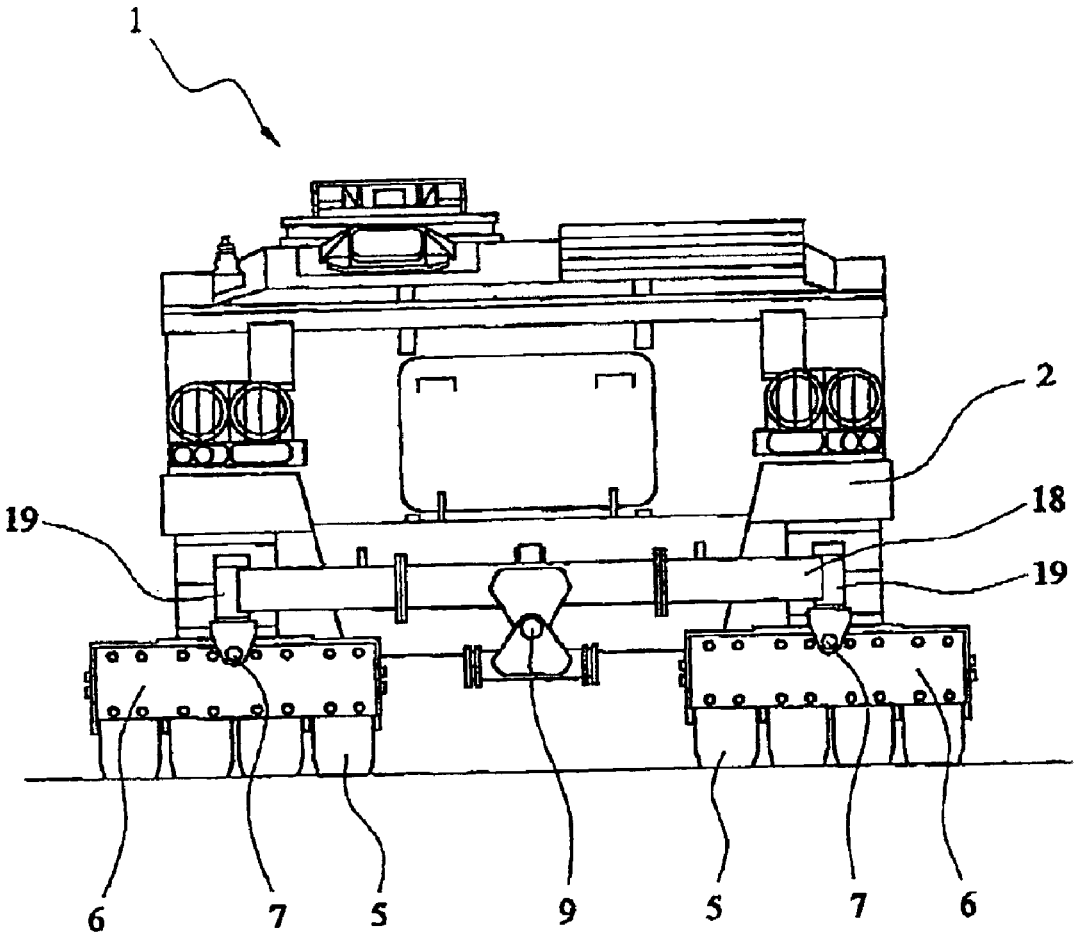
FIG. 2 is a front elevation view of the vehicle of FIG. 1.
Figure 3:
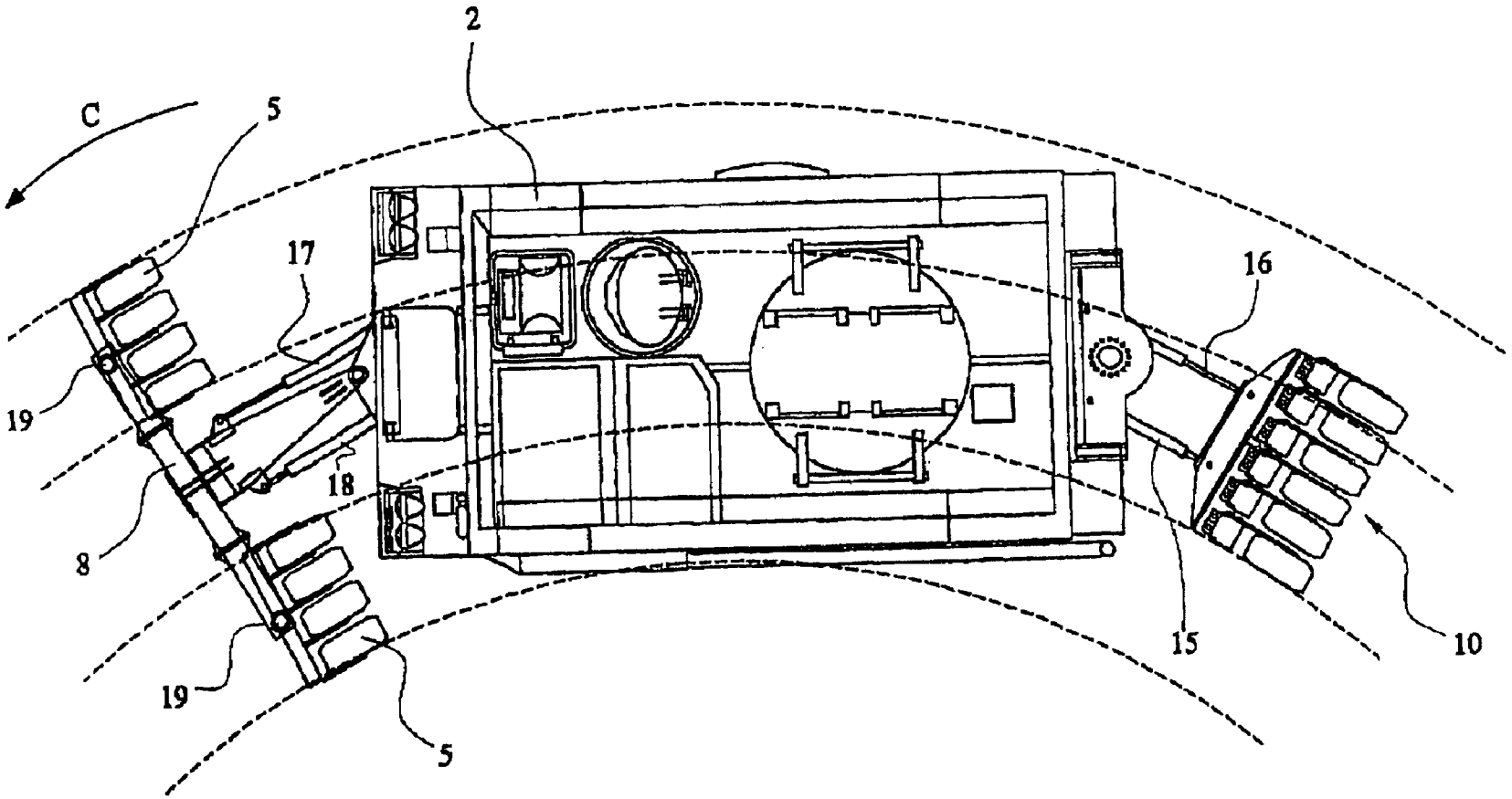
FIG. 3 is a plan view of the vehicle of FIGS. 1 and 2.

Referring to FIGS. 1 to 3, an armoured personnel carrier 1 comprises a vehicle body 2 supported on a pair of tracks 3. A front roller assembly 4 is arranged forwardly of each of the tracks 3 and each roller assembly 4 consists of a set of four solid rubber wheels 5, each of which is independently sprung in order to accommodate differences in the height of the ground.

The wheels 5 of the front roller assemblies 4 are mounted to supports 6, and each support 6 is connected via horizontal and vertical pivots 7 to a support frame 8. The support frame B is pivotable about a horizontal pivot 9 to accommodate unevenness in the ground. The wheels 5 and supports 6 are attached in such a way that the supports 6 shear from the support frame 8 in the event of a mine detonating against one of the wheels 5 with sufficient force, and the supports 6 are also attached to the vehicle by means of hydraulically retractable pins 22, 23 so that the wheels 5 can be jettisoned when damaged without exposing personnel in the vehicle to danger. The forward roller assemblies 4 can also be disengaged from the ground by pivoting in the direction of arrow A shown in FIG. 1.

A rear roller assembly 10 comprises a set of six wheels 11 and is mounted to a frame 12 that can pivot about horizontal and vertical axes. Each of the wheels 11 is mounted on independent suspension to allow the wheels to accommodate different heights of ground surface. The rear roller set 10 can be disengaged from the ground by pivoting in the direction of arrow B shown in FIG. 1 about pivot 13 so that the vehicle can be reversed.

The rear roller unit 10 is attached to the vehicle by a remotely controlled hydraulically retractable pin 22 which allow the entire rear roller except for the lift frame 14 to be jettisoned without exposing personnel to danger. Similarly, the front roller assembly 4 can be jettisoned by the retraction of remotely controlled hydraulic pin 23. The front rollers 4 are pre-loaded by a force applying hydraulic cylinder 20, and the rear rollers 10 are pre-loaded by a force applying hydraulic cylinder 21, to give a force on the ground equivalent to 400 kg per wheel.

Referring now to FIG. 3, the rear roller assembly 10 is connected to the vehicle body 2 by means of a pair of hydraulic cylinders 15, 16. Similarly, the support frame 8 supporting the front roller assemblies 4 is connected to the vehicle body 2 by means of a pair of hydraulic cylinders 17, 18. Hydraulic cylinder 15 is connected to hydraulic cylinder 17, so that as the cylinder 15 is compressed, the cylinder 17 extends, and vice versa. The cylinder 16 is connected to cylinder 18 in a similar manner, so that as cylinder 16 is compressed, cylinder 18 extends and vice versa.

The operation of the vehicle shown in the Figures will now be described.

As the vehicle 1 begins to travel in a curved path, the vehicle body 2 pivots relative to the rear roller assembly 10, compressing hydraulic cylinder 15 as shown in FIG. 3. This causes hydraulic cylinder 17 to extend, as a result of which the front roller assemblies 4 pivot in the direction of arrow C shown in FIG. 3. This causes the position of the wheels 5 of the front roller assemblies 4 to be maintained in front of the tracks 3 of the vehicle, Because each of the front roller assemblies 4 can castor about pivots 19, this minimises the force required to achieve this movement.

As the vehicle then begins to travel along a straight path, movement of the vehicle body 2 relative to the rear roller assembly 10 compresses cylinder 16, which in turn causes hydraulic cylinder 18 to extend. This in turn causes the path of the front roller assemblies 4 to straighten relative to the vehicle body 2; maintaining the position of the front roller assemblies 4 in front of the tracks 3 of the vehicle. In this way, by mines in front of the tracks 3 of the vehicle 1 are detonated by the front roller assemblies 4 before the vehicle body 2 passes over that position, and any mines lying between the tracks 3 are subsequently detonated by the rear roller assembly 6 after the vehicle body 2 has passed. Any detonating nines therefore damage the wheels of the front or rear roller assemblies without causing injury to personnel in the vehicle 1.

It will be appreciated by persons skilled in the art that the above embodiment has been described by way of example only, and not in any limitative sense, and that various alterations and modifications are possible without departure from the scope of the invention as defined by the appended claims.

What is claimed is:

1. A mine detonating apparatus comprising:

at least one first roller assembly adapted to be mounted at the front of a body of a vehicle and to apply pressure to the ground forwardly of a respective wheel and/or track of the vehicle;

at least one second roller assembly adapted to be mounted behind the vehicle and to apply pressure to the ground behind the vehicle;

at least one force applying device adapted to cause the or each said roller assembly to apply force to the ground; and at least one guide device adapted to maintain the position of the or each said first roller assembly relative to the body of the vehicle such that the or each wheel and/or track of the vehicle follows a path of at least one of said at least one first roller assembly when the vehicle travels along a curved path.

2. An apparatus according to claim 1, wherein at least one of said at least one guide device comprises at least one interconnecting device connected in use between said first and second roller assemblies such that pivoting of the body of said vehicle about a respective substantially vertical axis relative to the or each said second roller assembly causes pivoting of the or each said first roller assembly relative to the body of the vehicle.

3. An apparatus according to claim 2, wherein at least one of said at least one interconnecting device comprises a mechanical linkage.

4. An apparatus according to claim 2, wherein at least one of said at least one interconnecting device comprises at least one first pair of hydraulic cylinders arranged in use between the body of the vehicle and the or each said first roller assembly and at least one second pair of hydraulic cylinders arranged in use between the body of the vehicle and the or each said second roller assembly.

5. An apparatus according to claim 1, wherein at least one of said at least one guide device comprises at least one position sensing device for determining the position of the or each said second roller assembly relative to the corresponding track and/or wheel of the vehicle, and at least one motor device for controlling the position of the or cash said first roller assembly in response to at least one of said at least one position sensing device.

6. An apparatus according to claim 5, wherein at least one of said at least one guide device in use determines a respective turning circle of the or each said first roller assembly by comparing the speed of wheels and/or tracks on opposite sides of the vehicle.

7. An apparatus according to claim 1, wherein the or each said first and/or second roller assembly is mounted to at least one frame and is adapted to be released from the body of the vehicle in use by at least one remote control device.

8. An apparatus according to claim 7, wherein the or each said first roller assembly is mounted to at least one of said at least one frame in use and is adapted to be released from at least one of said at least one frame by at least one of said at least one remote control device.

9. An apparatus according claim 7, wherein the or each said second roller assembly is mounted to at least one of said at least one frame in use, and the or each said frame is adapted to be released from the body of the vehicle by at least one of said at least one remote control device.

10. An apparatus according to claim 7, wherein said remote control device comprises at least one retractable pin.

11. An apparatus according to claim 1, wherein the or each said first and/or said second roller assembly is adapted to pivot about a respective substantially horizontal axis substantially parallel to the direction of travel of the vehicle in use and/or about a substantially vertical axis.

12. An apparatus according to claim 1, wherein the or each said roller assembly comprises a plurality of wheels.

13. An apparatus according to claim 12, wherein the wheels of the or each said roller assembly are suspended independently of each other.

14. An apparatus according to claim 1, comprising two said first said second roller assemblies and said second roller assembly, wherein said second roller assembly in use is adapted to engage the entire width of ground between the ground engaged by said first roller assemblies.

15. An apparatus according to claim 1, wherein at least one of said at least one force applying device comprises at least one hydraulic cylinder.

16. A vehicle comprising a mine detonating apparatus according to claim 1.

17. A vehicle according to claim 16, wherein the vehicle is an armored personnel carrier.

18. A mine detonating method comprising:

providing a mine detonating apparatus including at least one first roller assembly adapted to be mounted at the front of a body of a vehicle and to apply pressure to the ground forwardly of a respective wheel and/or track of the vehicle, at least one second roller assembly adapted to be mounted behind the vehicle and to apply pressure to the ground behind the vehicle, at least one force applying device adapted to cause the or each said roller assembly to apply force to the ground, and at least one guide device adapted to maintain the position of the or each said first roller assembly relative to the body of the vehicle such that the or each wheel and/or track of the vehicle follows a path of at least one of said at least one first roller assembly when the vehicle travels along a curved path; and detonating mines utilizing the mine detonating apparatus.

* * * * *

UNITED STATES PATENT AND TRADEMARK OFFICE

CERTIFICATE OF CORRECTION

PATENT NO. : 6,915,728 B2
APPLICATION NO. : 10/312945
DATED : July 12, 2005
INVENTOR(S) : Renwick et al.

It is certified that error appears in the above-identified patent and that said Letters Patent is hereby corrected as shown below:

Col. 5, line 30, replace “cash” with --each--;
Col. 5, line 47, replace “according claim” with --according to claim--;
Col. 6, line 17, replace “first said second roller” with --first roller--;
Col. 6, line 17, replace “and said” with --and a said--.

Signed and Sealed this
Seventeenth Day of May, 2011

David J. Kappos

David J. Kappos
*Director of the United States Patent and Trademark Office*